US010914294B2

(12) United States Patent
Miura et al.

(10) Patent No.: US 10,914,294 B2
(45) Date of Patent: Feb. 9, 2021

(54) DISPLACEMENT ADJUSTING DEVICE OF SWASH PLATE PUMP

(71) Applicant: KAWASAKI JUKOGYO KABUSHIKI KAISHA, Kobe (JP)

(72) Inventors: Hidetoshi Miura, Akashi (JP); Masahiro Goto, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 303 days.

(21) Appl. No.: 16/061,503

(22) PCT Filed: Nov. 8, 2016

(86) PCT No.: PCT/JP2016/083084
§ 371 (c)(1),
(2) Date: Jun. 12, 2018

(87) PCT Pub. No.: WO2017/110274
PCT Pub. Date: Jun. 29, 2017

(65) Prior Publication Data

US 2020/0263675 A1 Aug. 20, 2020

(30) Foreign Application Priority Data

Dec. 25, 2015 (JP) ..... 2015-253200

(51) Int. Cl.
*F04B 1/20* (2020.01)
*F04B 1/324* (2020.01)
*F04B 1/2042* (2020.01)
*F04B 49/00* (2006.01)

(52) U.S. Cl.
CPC ..... *F04B 1/324* (2013.01); *F04B 1/2042* (2013.01); *F04B 49/002* (2013.01)

(58) Field of Classification Search
CPC ..... F04B 1/2078; F04B 1/324; F04B 1/2042; F04B 49/002
See application file for complete search history.

(56) References Cited

U.S. PATENT DOCUMENTS 6,725,658 B1 * 4/2004 Lemmen ..... F04B 1/324 60/443
2014/0116242 A1 5/2014 Howind et al.

FOREIGN PATENT DOCUMENTS

JP 4691299 B2 6/2011

* cited by examiner

*Primary Examiner* — Abiy Teka
(74) *Attorney, Agent, or Firm* — Oliff PLC

(57) ABSTRACT

A displacement adjusting device of a swash plate pump includes: a tilting piston slidably inserted in a housing's accommodating hole, the tilting piston pressing the swash plate pump's swash plate; a sleeve forming a control pressure chamber between the sleeve and tilting piston, the sleeve including a pump port, tank port, and output port; a spool slidably held by the sleeve, the spool switching whether to bring output port into communication with one of the pump port and tank port or block the output port from the pump and tank port; a tilting spring urging the tilting piston and spool away from each other; and a solenoid including a rod that presses the spool from an opposite side to tilting spring. In the sleeve, reaction force chamber and communication passage are formed. The communication passage being a passage through which the control pressure chamber communicates with reaction force chamber.

12 Claims, 8 Drawing Sheets

DISPLACEMENT ADJUSTING DEVICE OF SWASH PLATE PUMP

TECHNICAL FIELD

The present invention relates to a displacement adjusting device of a swash plate pump.

BACKGROUND ART

Conventionally, there is a known displacement adjusting device that electrically changes the displacement (i.e., displaced volume) of a swash plate pump. For example, Patent Literature 1 discloses a displacement adjusting device 100 of a swash plate pump as shown in FIG. 9.

Specifically, the displacement adjusting device 100 includes a housing 110 incorporated in the casing of the swash plate pump. The housing 110 is provided with an accommodating hole 111, which extends from the outside toward a swash plate 180. In the forward part of the accommodating hole 111 at the swash plate 180 side, a tilting piston 120 is held, which presses the swash plate 180. In the rearward part of the accommodating hole 111 at the opposite side to the swash plate 180, a first sleeve 130 is fixed. A solenoid 160 is fixed to the first sleeve 130, and a second sleeve 140 is disposed in the first sleeve 130. A spool 150 is held by the second sleeve 140.

A control pressure chamber 101 is formed between the second sleeve 140 and the tilting piston 120. A reaction force chamber 102 is formed at the opposite side to the control pressure chamber 101, with the second sleeve 140 positioned between the control pressure chamber 101 and the reaction force chamber 102. The front end portion of the spool 150 is exposed in (i.e., facing) the control pressure chamber 101, and the rear end portion of the spool 150 is exposed in (i.e., facing) the reaction force chamber 102. The front end portion of the spool 150 is urged by a tilting spring 170 disposed in the control pressure chamber 101, and the rear end portion of the spool 150 is pressed by a rod 161 of the solenoid 160. A communication passage 151, through which the control pressure chamber 101 communicates with the reaction force chamber 102, is formed in the spool 150, such that the communication passage 151 extends through the spool 150 in the axial direction.

An inner pump port 141 and an inner tank port 142 are formed in the second sleeve 140. An outer pump port 131, which communicates with the inner pump port 141, is formed in the first sleeve 130. An outer tank port 132, which communicates with the inner tank port 142, is also formed in the first sleeve 130. An output port 143, which communicates with the control pressure chamber 101, is formed in the second sleeve 140. The spool 150 switches whether to bring the output port 143 into communication with one of the inner pump port 141 and the inner tank port 142 or block the output port 143 from the inner pump port 141 and the inner tank port 142.

When the solenoid 160 is supplied with a current, the position of the spool 150 is determined such that the pressing force of the rod 161 against the spool 150 is in balance with the urging force of the tilting spring 170 against the spool 150. Accordingly, the higher the current supplied to the solenoid 160, the greater the displacement of the swash plate pump.

CITATION LIST

Patent Literature

PTL 1: Japanese Patent No. 4691299

SUMMARY OF INVENTION

Technical Problem

However, since the two sleeves 130 and 140 are used in the displacement adjusting device 100 shown in FIG. 9, the structure is complex and the manufacturing cost is high. Moreover, since the communication passage 151, through which the control pressure chamber 101 communicates with the reaction force chamber 102, is formed in the spool 150, it is difficult to make the spool 150 compact.

In view of the above, an object of the present invention is to provide a displacement adjusting device of a swash plate pump, the displacement adjusting device making it possible to reduce the manufacturing cost and to make the entire swash plate pump compact by making the spool compact.

Solution to Problem

In order to solve the above-described problems, a displacement adjusting device of a swash plate pump according to the present invention includes: a housing incorporated in a casing of the swash plate pump, the housing including an accommodating hole; a tilting piston slidably inserted in the accommodating hole, the tilting piston pressing a swash plate of the swash plate pump; a sleeve inserted in the accommodating hole and forming a control pressure chamber between the sleeve and the tilting piston, the sleeve including a pump port, a tank port, and an output port; a spool slidably held by the sleeve, the spool switching whether to bring the output port into communication with one of the pump port and the tank port or block the output port from the pump port and the tank port; a tilting spring disposed in the control pressure chamber, the tilting spring urging the tilting piston and the spool away from each other; and a solenoid including a rod that presses the spool from an opposite side to the tilting spring. In the sleeve, a reaction force chamber and a communication passage are formed, the reaction force chamber being formed at an opposite side to the control pressure chamber, the communication passage being a passage through which the control pressure chamber communicates with the reaction force chamber.

According to the above configuration, since the single sleeve is used, the manufacturing cost can be reduced. In addition, since the communication passage, through which the control pressure chamber communicates with the reaction force chamber, is formed in the sleeve, the spool can be made compact. Consequently, the entire swash plate pump can be made compact.

In the housing, a first control pressure passage that communicates with the output port and a second control pressure passage that communicates with the control pressure chamber may be formed, the first control pressure passage and the second control pressure passage each forming a part of a control pressure line that connects the output port to the control pressure chamber. According to this configuration, the displacement adjustment function can be combined with any other function(s) by providing an additional-function valve(s) on the control pressure line.

The above displacement adjusting device may further include: at least one additional-function valve provided on the control pressure line; a bypass line that connects a part of the control pressure line upstream of the at least one additional-function valve and a part of the control pressure line downstream of the at least one additional-function valve; and a check valve provided on the bypass line, the check valve allowing a flow from the part of the control pressure line upstream of the at least one additional-function valve toward the part of the control pressure line downstream of the at least one additional-function valve and preventing a reverse flow. According to this configuration, even in a case where the additional-function valve blocks the control pressure line, proper responsiveness can be obtained for the displacement adjustment.

The swash plate may be urged by a swash plate spring from an opposite side to the tilting piston. The spool may be configured to block the pump port and bring the tank port into communication with the reaction force chamber when no current is supplied to the solenoid. According to this configuration, when a failure occurs in an electrical system, the pressure in the control pressure chamber decreases, which causes the tilting piston to shift fully rearward, and thereby the displacement of the swash plate pump is maximized. In this manner, a fail-safe function against an electrical system failure is realized.

The spool may be configured to be pressed by the rod to bring the pump port into communication with the output port and block the tank port from the reaction force chamber when a current between a first setting value and a second setting value is supplied to the solenoid. According to this configuration, when the current between the first setting value and the second setting value is supplied to the solenoid, the tilting piston shifts fully forward, and thereby the displacement of the swash plate pump is minimized. That is, by supplying a current higher than the first setting value to the solenoid, the fail-safe state can be switched to a standby state.

The tilting piston may press the swash plate via a tilting pin that extends in a direction orthogonal to a swinging direction of the swash plate. According to this configuration, wear resistance can be improved compared to a case where the tilting piston presses the swash plate via a sphere.

Advantageous Effects of Invention

The present invention provides a displacement adjusting device that makes it possible to reduce the manufacturing cost and to make the entire swash plate pump compact by making the spool compact.

DESCRIPTION OF EMBODIMENTS

Figure 1:
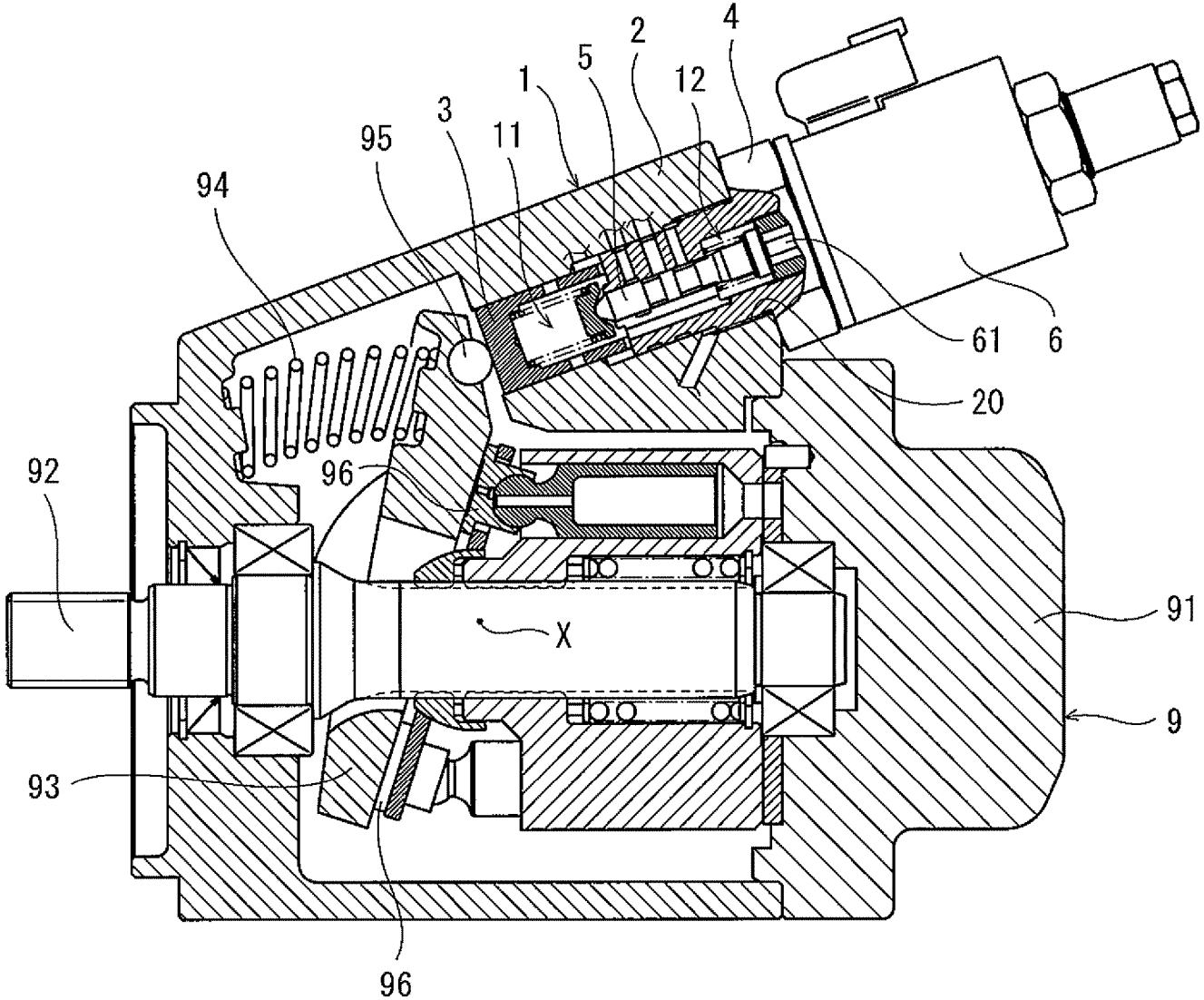
FIG. 1 is a sectional view of a displacement adjusting device of a swash plate pump according to one embodiment of the present invention and the swash plate pump provided with the displacement adjusting device.
Figure 4:
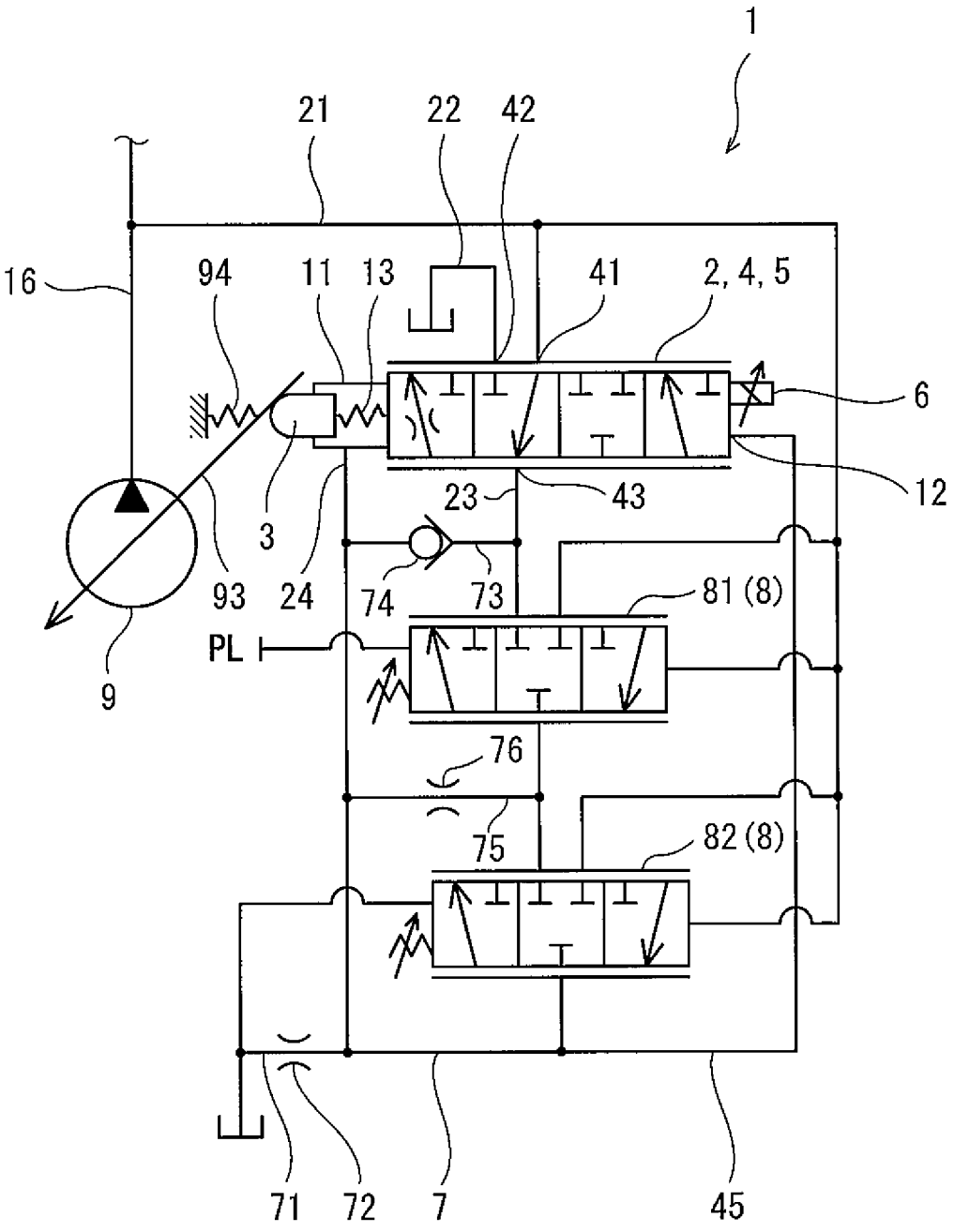
FIG. 4 shows a hydraulic circuit of the displacement adjusting device.
Figure 5:
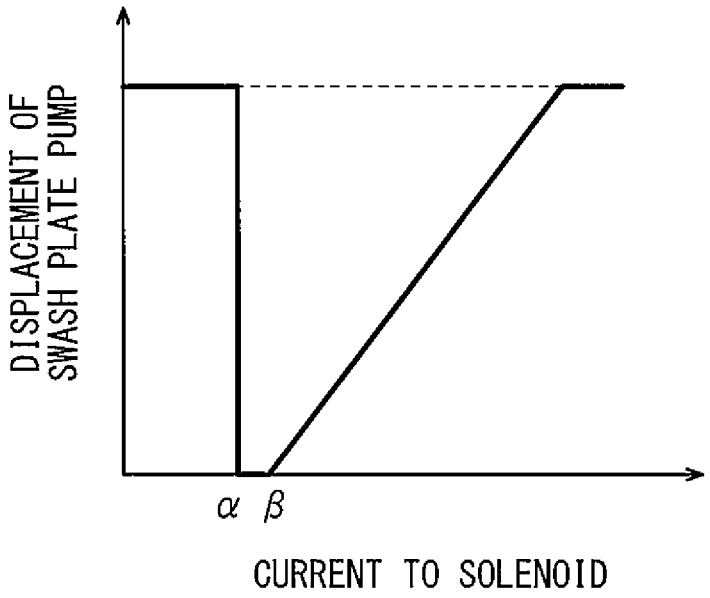
FIG. 5 is a graph showing a relationship between the current supplied to the solenoid and the displacement of the swash plate pump.

FIG. 1 shows a displacement adjusting device 1 of a swash plate pump according to one embodiment of the present invention and a swash plate pump 9 provided with the displacement adjusting device 1. FIG. 4 shows the hydraulic circuit of the displacement adjusting device 1, and FIG. 5 shows the performance of the displacement adjusting device 1.

The swash plate pump 9 includes: a casing 91; a rotary shaft 92 extending from the inside of the casing 91, the rotary shaft 92 penetrating the casing 91; and a swash plate 93 configured to be swingable relative to the rotary shaft 92. The distal end of the rotary shaft 92 is coupled to an output shaft of a drive unit (e.g., an engine).

The displacement adjusting device 1 is disposed laterally to the rotary shaft 92. Hereinafter, for the sake of convenience of the description, between the directions orthogonal to the rotary shaft 92, the direction from the rotary shaft 92 toward the displacement adjusting device 1 is referred to as the upward direction, and the opposite direction is referred to as the downward direction. Also, between the axial directions of the rotary shaft 92, the direction toward the distal end of the rotary shaft 92 is referred to as the forward direction, and the opposite direction is referred to as the rearward direction.

In the present embodiment, the swash plate 93 swings relative to a recessed arc surface of a swash plate support that is not shown, and the swinging center X of the swash plate 93 is not positioned on the center line of the rotary shaft 92, but deviates upward from the center line of the rotary shaft 92. The front surface of the swash plate 93 is urged by a swash plate spring 94 in such a direction as to increase the displacement of the swash plate pump 9. A plurality of shoes 96 slide on the rear surface of the swash plate 93.

The displacement adjusting device 1 includes a housing 2 incorporated in the casing 91 of the swash plate pump 9. It should be noted that, in the present embodiment, the casing 91 of the swash plate pump 9 and the housing 2 of the displacement adjusting device 1 are the same member. The housing 2 is provided with an accommodating hole 20, which extends straight from the outside toward the upper part of the rear surface of the swash plate 93. In the present embodiment, the center line of the accommodating hole 20 is inclined, such that the distance between the center line of the accommodating hole 20 and the center line of the rotary shaft 92 increases rearward. However, as an alternative, the center line of the accommodating hole 20 may be parallel to the center line of the rotary shaft 92.

Figure 2:
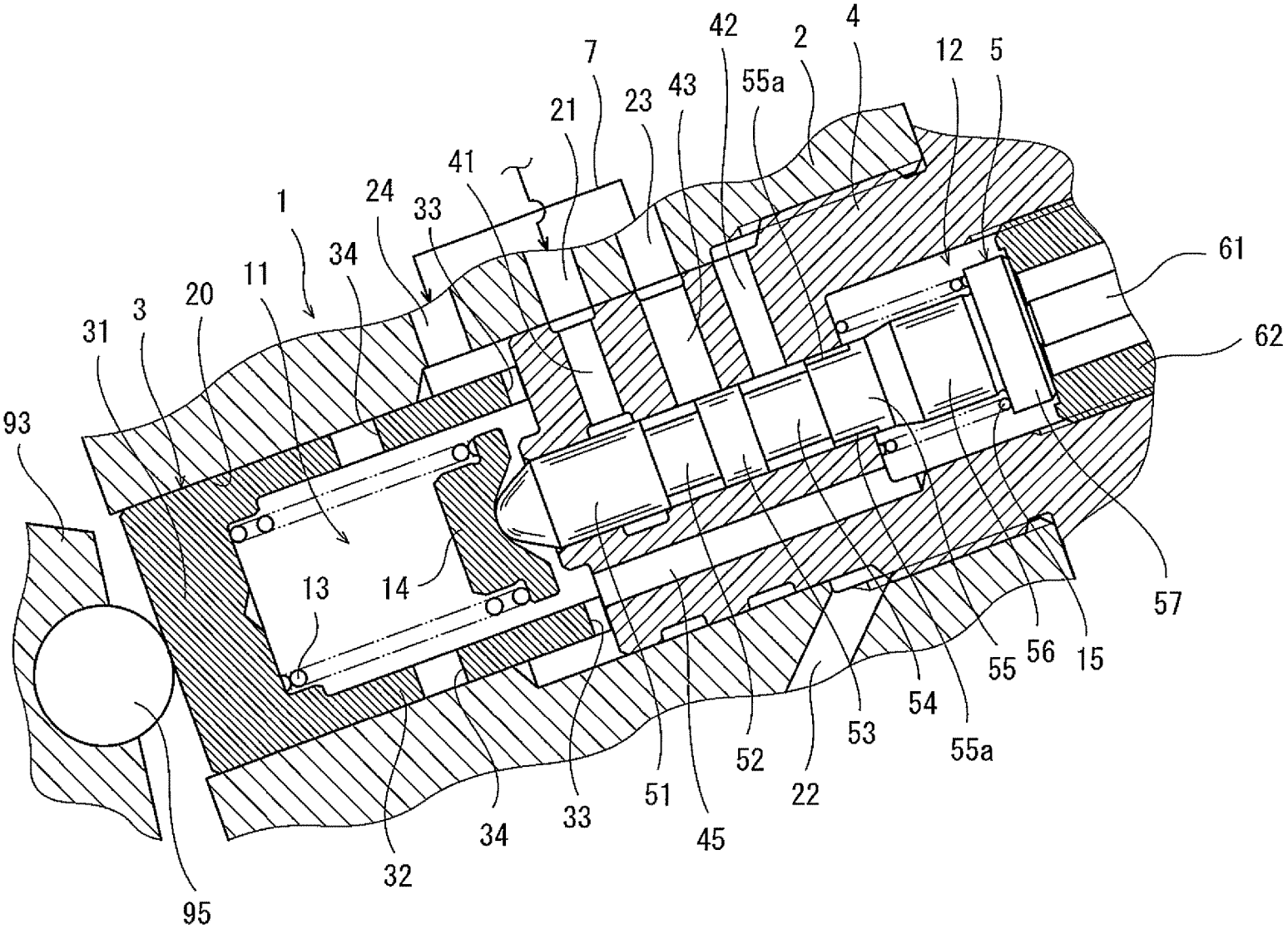
FIG. 2 is an enlarged view of an essential part of FIG. 1, showing a state where no current is supplied to a solenoid.

As shown in FIG. 2, in the forward part of the accommodating hole 20, a tilting piston 3 is slidably inserted. The tilting piston 3 presses the swash plate 93 via a tilting pin 95. That is, the aforementioned swash plate spring 94 urges the swash plate 93 from the opposite side to the tilting piston 3.

The tilting pin 95 extends in a direction orthogonal to the swinging direction of the swash plate 93 (in FIG. 2, the tilting pin 95 extends in a direction orthogonal to the plane of FIG. 2; hereinafter, the extending direction of the tilting pin 95 is referred to as "right-left direction"). In the present embodiment, the tilting pin 95 is held by the swash plate 93, and slides on the tilting piston 3. Alternatively, the tilting pin 95 may be held by the tilting piston 3 and may slide on the swash plate 93. Further alternatively, a sphere can be used instead of the tilting pin 95.

Figure 6:
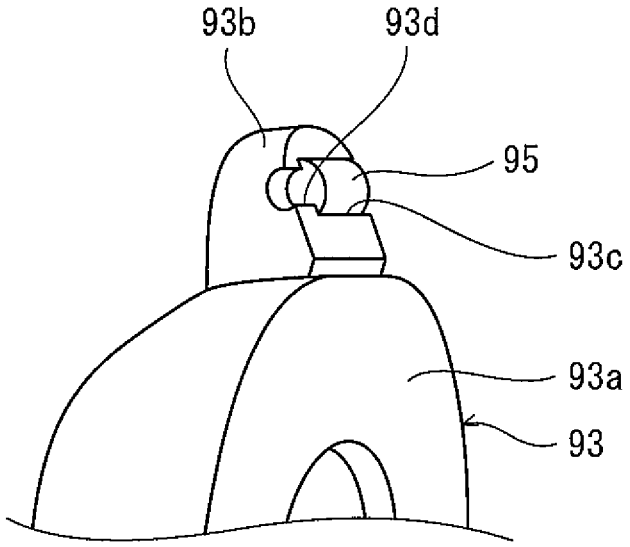
FIG. 6 is a perspective view of a part of a swash plate.

More specifically, as shown in FIG. 6, the swash plate 93 includes: an annular body 93*a*, in which the rotary shaft 92 is inserted; and a lug 93*b*, which protrudes upward from the body 93*a*. The lug 93*b* is provided with a holding hole 93*c*, which extends in the right-left direction. The tilting pin 95 is press-fitted in the holding hole 93*c*. One end of the holding hole 93*c* is provided with a stepped portion 93*d*. The tilting pin 95 is press-fitted to a position where the tilting pin 95 contacts with the stepped portion 93*d*. It should be noted that the tilting pin 95 is secured within the holding hole 93*c* by a set screw that is not shown.

Returning to FIG. 1 and FIG. 2, a sleeve 4 is inserted in the rearward part of the accommodating hole 20. The sleeve 4 is fixed to the rearward part of the accommodating hole 20 by a screw structure. A metal-touch sealing structure, or a sealing structure utilizing a sealing member such as an O-ring, may be adopted to seal between the outer periphery of the sleeve 4 and the inner periphery of the accommodating hole 20. A solenoid 6 is disposed rearward of the sleeve 4, and a spool 5 is disposed in the sleeve 4. The spool 5 is slidably held by the sleeve 4.

The sleeve 4 forms a control pressure chamber 11 in the accommodating hole 20 between the sleeve 4 and the tilting piston 3. In the rearward part of the sleeve 4 (i.e., at the opposite side to the control pressure chamber 11), a reaction force chamber 12 is formed. The front end portion of the spool 5 is exposed in (i.e., facing) the control pressure chamber 11, and the rear end portion of the spool 5 is exposed in (i.e., facing) the reaction force chamber 12.

In the present embodiment, the tilting piston 3 includes: a discoid main wall 31 orthogonal to the axial direction of the accommodating hole 20; and a peripheral wall 32, which extends rearward from the peripheral edge of the main wall 31 in the axial direction of the accommodating hole 20. The rear end of the peripheral wall 32 is provided with a plurality of grooves 33 so that, even when the tilting piston 3 contacts with the sleeve 4, the control pressure chamber 11 will not be divided into an inner part surrounded by the peripheral wall 32 and an outer part surrounding the peripheral wall 32. Also in the middle of the peripheral wall 32, a plurality of through-holes 34 are provided. When the through-holes 34 reach a position where the through-holes 34 communicate with the inside of the casing 91 of the swash plate pump 9, the pressure in the control pressure chamber 11 decreases, and for this reason, the tilting piston 3 loses its driving force, becoming unable to make a stroke any more. That is, this position determines the minimum displaced volume of the swash plate pump 9.

In the control pressure chamber 11 (more specifically, inside the peripheral wall 32 of the tilting piston 3), a tilting spring 13 is disposed. The tilting spring 13 urges the tilting piston 3 and the spool 5 away from each other. In the present embodiment, the tilting spring 13 urges the front end portion of the spool 5 via a spring seat 14. However, depending on the shape of the spool 5, the front end portion of the spool 5 may be directly urged by the tilting spring 13.

In the sleeve 4, a pump port 41, an output port 43, and a tank port 42 are provided, such that the ports 41, 43, and 42 are arranged from forward to rearward. These ports 41 to 43 extend in the radial direction of the sleeve 4. In addition, a communication passage 45, through which the control pressure chamber 11 communicates with the reaction force chamber 12, is formed in the sleeve 4. The communication passage 45 extends in the axial direction of the sleeve 4.

A supply passage 21, which communicates with the pump port 41, and a discharge passage 22, which communicates with the tank port 42, are formed in the housing 2. As shown in FIG. 4, the supply passage 21 is connected to a discharge line 16, which extends from the swash plate pump 9, and the supply passage 21 forms a branch line that branches off from the discharge line 16. The discharge passage 22 is open inside the casing 91 of the swash plate pump 9, and forms a tank line as shown in FIG. 4.

A first control pressure passage 23, which communicates with the output port 43, and a second control pressure passage 24, which communicates with the control pressure chamber 11, are also formed in the housing 2. As shown in FIG. 4, the first control pressure passage 23 forms the upstream end of a control pressure line 7, which connects the output port 43 to the control pressure chamber 11, and the second control pressure passage 24 forms the downstream end of the control pressure line 7.

In the present embodiment, as shown in FIG. 4, two additional-function valves 8, i.e., a load-sensing valve 81 and a cutoff valve 82, are provided on the control pressure line 7. Alternatively, only one of the load-sensing valve 81 and the cutoff valve 82 or neither of these valves may be provided on the control pressure line 7. It should be noted that a different additional-function valve(s) other than the load-sensing valve 81 and the cutoff valve 82 may be provided on the control pressure line 7. The load-sensing valve 81 moves in accordance with a pressure difference between the discharge pressure of the swash plate pump 9 and the maximum load pressure PL among the load pressures of respective actuators (not shown) to which working fluid (e.g., hydraulic oil) is supplied from the swash plate pump 9. The cutoff valve 82 moves in accordance with a pressure difference between the discharge pressure of the swash plate pump 9 and a preset spring pressure. A tank line 71 branches off from the control pressure line 7 at a position downstream of the cutoff valve 82, and the tank line 71 is provided with a restrictor 72.

In the present embodiment, a part of the control pressure line 7 upstream of the load-sensing valve 81 and a part of the control pressure line 7 downstream of the cutoff valve 82 are connected by a first bypass line 73. The first bypass line 73 is provided with a check valve 74. The check valve 74 allows a flow from the part of the control pressure line 7 upstream of the load-sensing valve 81 toward the part of the control pressure line 7 downstream of the cutoff valve 82, and prevents the reverse flow. It should be noted that the first bypass line 73 need not be provided with the check valve 74.

In the present embodiment, a part of the control pressure line 7 between the load-sensing valve 81 and the cutoff valve 82 and the part of the control pressure line 7 downstream of the cutoff valve 82 are connected by a second bypass line 75. The second bypass line 75 is provided with a restrictor 76.

As shown in FIG. 2, the aforementioned solenoid 6 is fixed to the rear end portion of the sleeve 4 by a screw structure. Specifically, the solenoid 6 includes: a tubular bolt portion 62, which protrudes into the sleeve 4; and a rod 61 inserted in the bolt portion 62. The rod 61 presses the rear end portion of the spool 5 from the opposite side to the tilting spring 13. The higher the current supplied to the solenoid 6, the greater the pressing force of the rod 61.

The distal end surface of the bolt portion 62 forms the rear wall surface of the reaction force chamber 12. When no current is supplied to the solenoid 6, the bolt portion 62 functions as a stopper of the spool 5 (when no current is supplied to the solenoid 6, the rear end portion of the spool 5 contacts with the bolt portion 62). It should be noted that the bolt portion 62 is configured such that the inside of the bolt portion 62 is not blocked from the reaction force chamber 12 even when the rear end portion of the spool 5 contacts with the bolt portion 62.

As shown in FIG. 4, the spool 5 switches whether to bring the output port 43 into communication with one of the pump port 41 and the tank port 42 or block the output port 43 from the pump port 41 and the tank port 42.

Specifically, as shown in FIG. 2, the spool 5 includes a forward land 51, a first small-diameter portion 52, a middle land 53, a second small-diameter portion 54, a rearward land 55, a spring support 56, and a large-diameter portion 57. These components 51 to 57 are arranged in this order from forward to rearward.

The lands 51, 53, and 55 have the same diameter, which is larger than the diameter of the small-diameter portions 52 and 54. The width of the middle land 53 is substantially equal to the diameter of the output port 43. As a result of the middle land 53 shifting, the output port 43 opens and closes (i.e., the opening area of the output port 43 is controlled), and the pressure in the control pressure chamber 11 is also controlled. That is, pressure control is performed by the middle land 53 and the output port 43 working together. It should be noted that an end portion of the middle land 53 may be tapered, or a notch may be formed in the end portion. On the inner peripheral surface of the sleeve 4, a groove may be formed in a peripheral surface portion that includes a position where the output port is open. The spring support 56 is positioned in the reaction force chamber 12, and has a diameter that is larger than the diameter of the rearward land 55. The large-diameter portion 57 has a diameter that is larger than the diameter of the spring support 56. The large-diameter portion 57 is urged toward the solenoid 6 by a return spring 15, in which the spring support 56 is inserted. It should be noted that the return spring 15 can be eliminated.

In the present embodiment, as shown in FIG. 5, the displacement adjusting device 1 maximizes the displacement of the swash plate pump 9 when the current supplied to the solenoid 6 is lower than a first setting value $\alpha$, brings the displacement of the swash plate pump 9 to zero when the current is between the first setting value $\alpha$ and a second setting value $\beta$, and increases the displacement of the swash plate pump 9 as the current increases from the second setting value $\beta$.

Specifically, when no current is supplied to the solenoid 6, i.e., when the spool 5 contacts with the bolt portion 62 of the solenoid 6, the forward land 51 of the spool 5 blocks the pump port 41 as shown in FIG. 2. Two grooves 55*a* are formed in the rearward land 55 of the spool 5. The two grooves 55*a* each extend from the front end of the rearward land 55 to the middle position thereof, and the two grooves 55*a* are spaced apart from each other by 180 degrees. When no current is supplied to the solenoid 6, the spool 5 brings the tank port 42 into communication with the reaction force chamber 12 through the grooves 55*a*. At the time, the grooves 55*a* function as a restrictor. As a result, the pressure in the control pressure chamber 11 is minimized. This state is kept while the current supplied to the solenoid 6 increases from zero to the first setting value $\alpha$. It should be noted that the number of grooves 55*a* may alternatively be one, or may be three or more.

Figure 3:
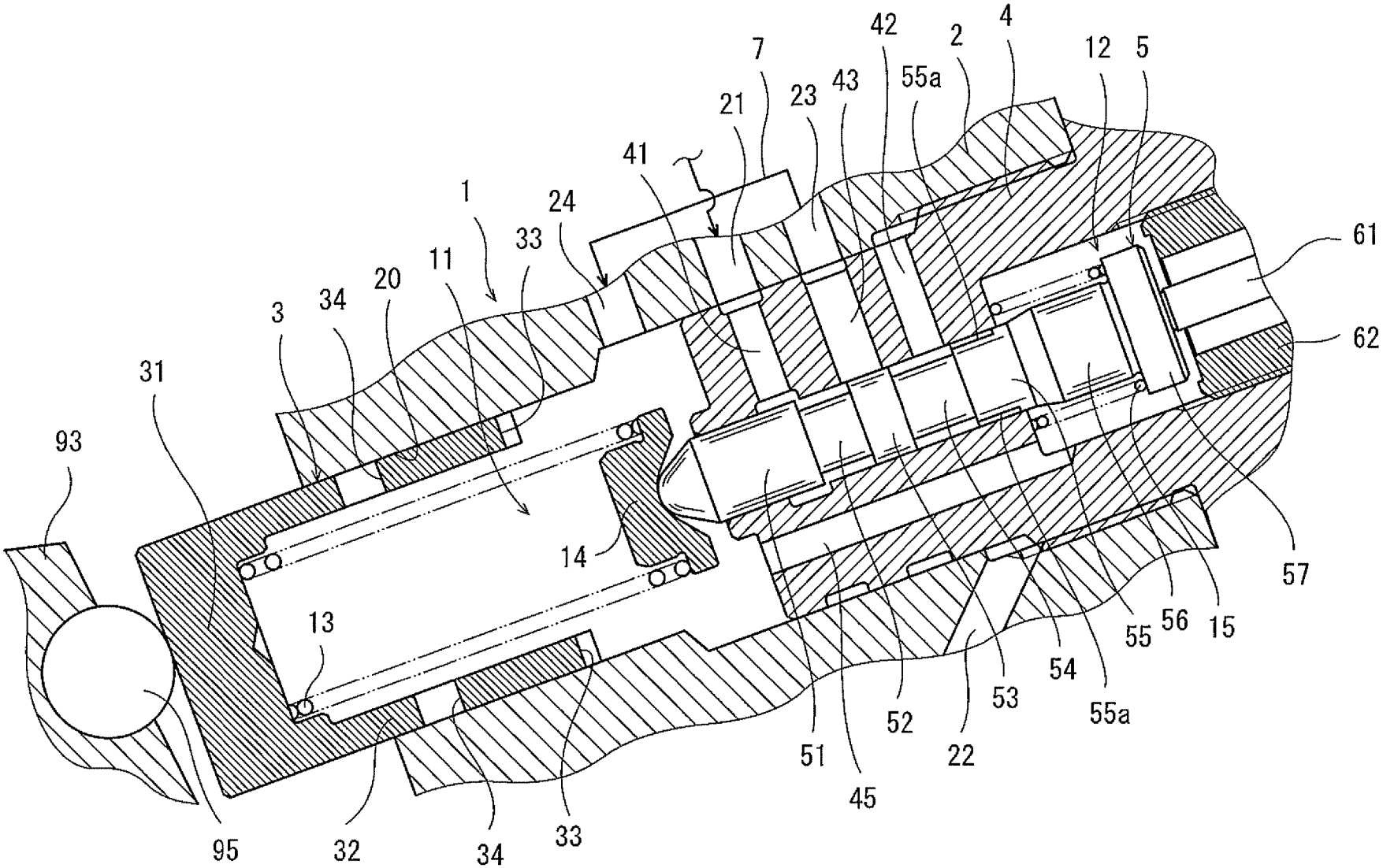
FIG. 3 is an enlarged view of the essential part of FIG. 1, showing a state where a current between a first setting value and a second setting value is supplied to the solenoid.

When the current supplied to the solenoid 6 is between the first setting value $\alpha$ and the second setting value $\beta$, as shown in FIG. 3, the spool 5 is pressed by the rod 61, such that the spool 5 brings the pump port 41 into communication with the output port 43 and blocks the tank port 42 from the reaction force chamber 12. As a result, the pressure in the control pressure chamber 11 is maximized (to a pump discharge pressure), and the displaced volume is minimized.

When a constant current higher than the second setting value $\beta$ is supplied to the solenoid 6, the middle land 53 shifts to a position where the middle land 53 blocks the output port 43. The pressure in the control pressure chamber 11 is adjusted by the middle land 53, and the tilting piston shifts to a position where the pressing force of the rod 61, which is exerted by the solenoid 6, and the urging force of the tilting spring 13, which is applied to the spool 5, are in balance. That is, the displaced volume is adjusted in accordance with the current value supplied to the solenoid 6.

Here, assume that a certain current is being supplied to the solenoid 6. Hereinafter, an operation that is performed when the current is lowered from this state is described.

When the current supplied to the solenoid 6 decreases, the spool 5 shifts to the right temporarily due to decrease in the pressing force of the rod 61 (electromagnetic force in the solenoid 6). As a result, the output port 43 comes into communication with the pump port 41, while the tank port 42 is kept blocked from the reaction force chamber 12. Accordingly, the pressure in the control pressure chamber 11 increases, and the tilting piston 3 shifts to the left. As a result, the displacement of the swash plate pump 9 decreases. When the tilting piston 3 shifts to the left, the urging force of the tilting spring 13 applied to the spool 5 decreases, and the spool 5 is pressed back to the left by the rod 61. In this manner, pressure control is performed by the middle land 53, and the position of the spool 5 is determined such that the pressing force of the rod 61 applied to the spool 5 and the urging force of the tilting spring 13 applied to the spool 5 are in balance.

As described above, in the displacement adjusting device 1 of the present embodiment, since the single sleeve 4 is used, the manufacturing cost can be reduced. In addition, since the communication passage 45, through which the control pressure chamber 11 communicates with the reaction force chamber 12, is formed in the sleeve 4, the spool 5 can be made compact. Consequently, the entire swash plate pump can be made compact.

Further, in the present embodiment, when no current is supplied to the solenoid 6, the pressure in the control pressure chamber 11 is minimized. Accordingly, when a failure occurs in an electrical system, the urging force of the swash plate spring 94 causes the tilting piston 3 to shift fully rearward, and thereby the displacement of the swash plate pump 9 is maximized. In this manner, a fail-safe function against an electrical system failure is realized. In the case of a construction machine, such as a hydraulic excavator, in which the swash plate pump 9 of the present embodiment is installed, even if a failure occurs in the electrical system of the displacement adjusting device 1, the work machine is guaranteed to work since the maximum flow rate is discharged from the swash plate pump 9.

Still further, in the present embodiment, when the current between the first setting value $\alpha$ and the second setting value $\beta$ is supplied to the solenoid 6, the tilting piston 3 shifts fully forward, and thereby the displacement of the swash plate pump 9 is minimized. That is, by supplying a current higher than the first setting value $\alpha$ to the solenoid 6, the fail-safe state can be switched to a standby state.

Still further, in the present embodiment, the part of the control pressure line 7 upstream of the load-sensing valve 81 and the part of the control pressure line 7 downstream of the cutoff valve 82 are connected by the first bypass line 73. Therefore, even in a case where the load-sensing valve 81 and/or the cutoff valve 82 block the control pressure line 7, proper responsiveness can be obtained for the displacement adjustment.

(Variations)

The present invention is not limited to the above-described embodiment. Various modifications can be made without departing from the spirit of the present invention.

Figure 7:
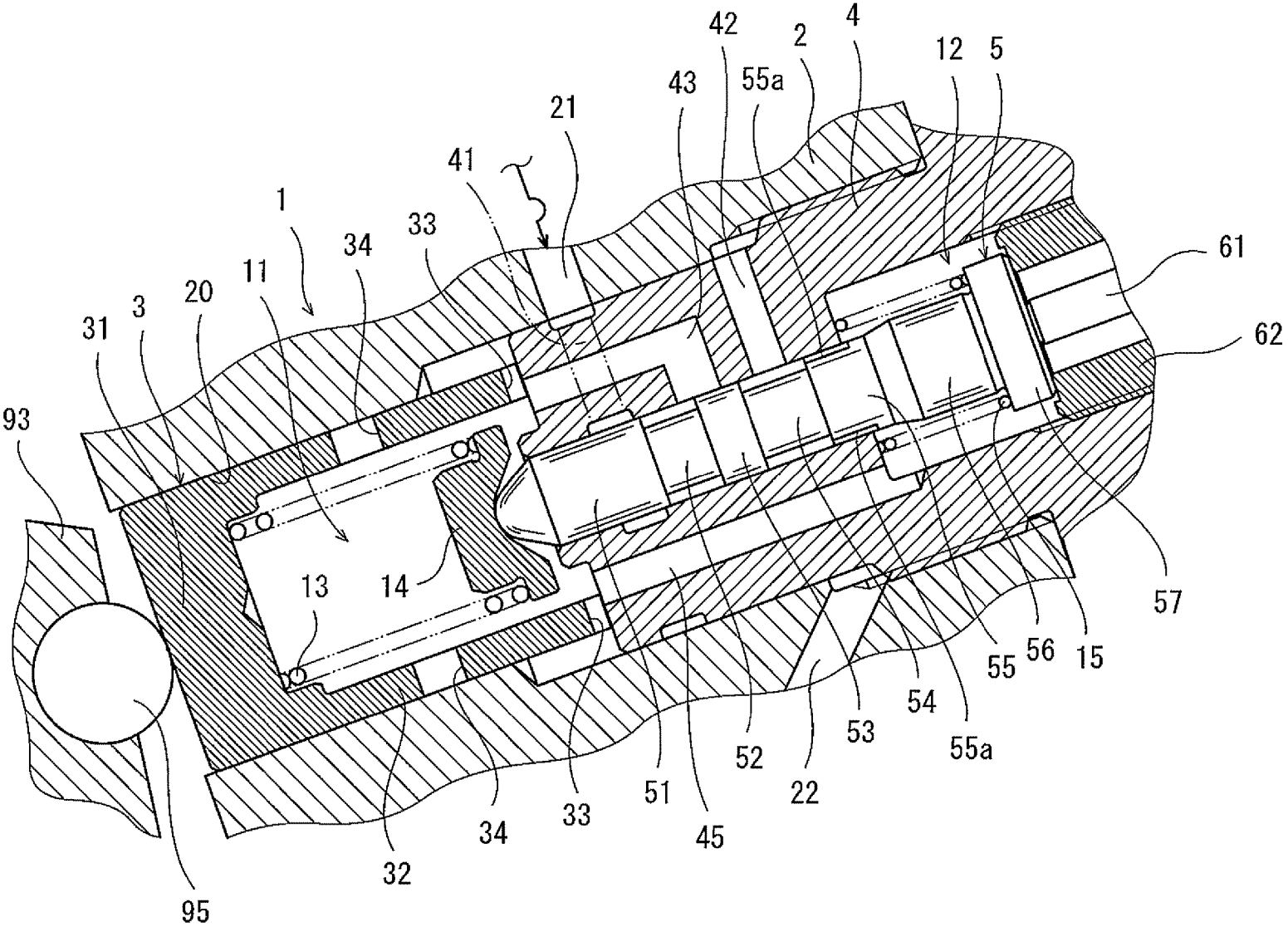
FIG. 7 is a sectional view of a part of a displacement adjusting device of a swash plate pump according to one variation.

For example, it is not essential that the first control pressure passage 23 and the second control pressure passage 24 be formed in the housing 2. As shown in FIG. 7, the output port 43 may directly communicate with the control pressure chamber 11. Alternatively, the output port 43 may be connected to the communication passage 45. However, if the first control pressure passage 23 and the second control pressure passage 24 are formed in the housing 2 as in the above-described embodiment, the displacement adjustment function can be combined with any other function(s) by providing an additional-function valve(s) 8 on the control pressure line 7.

Figure 8:
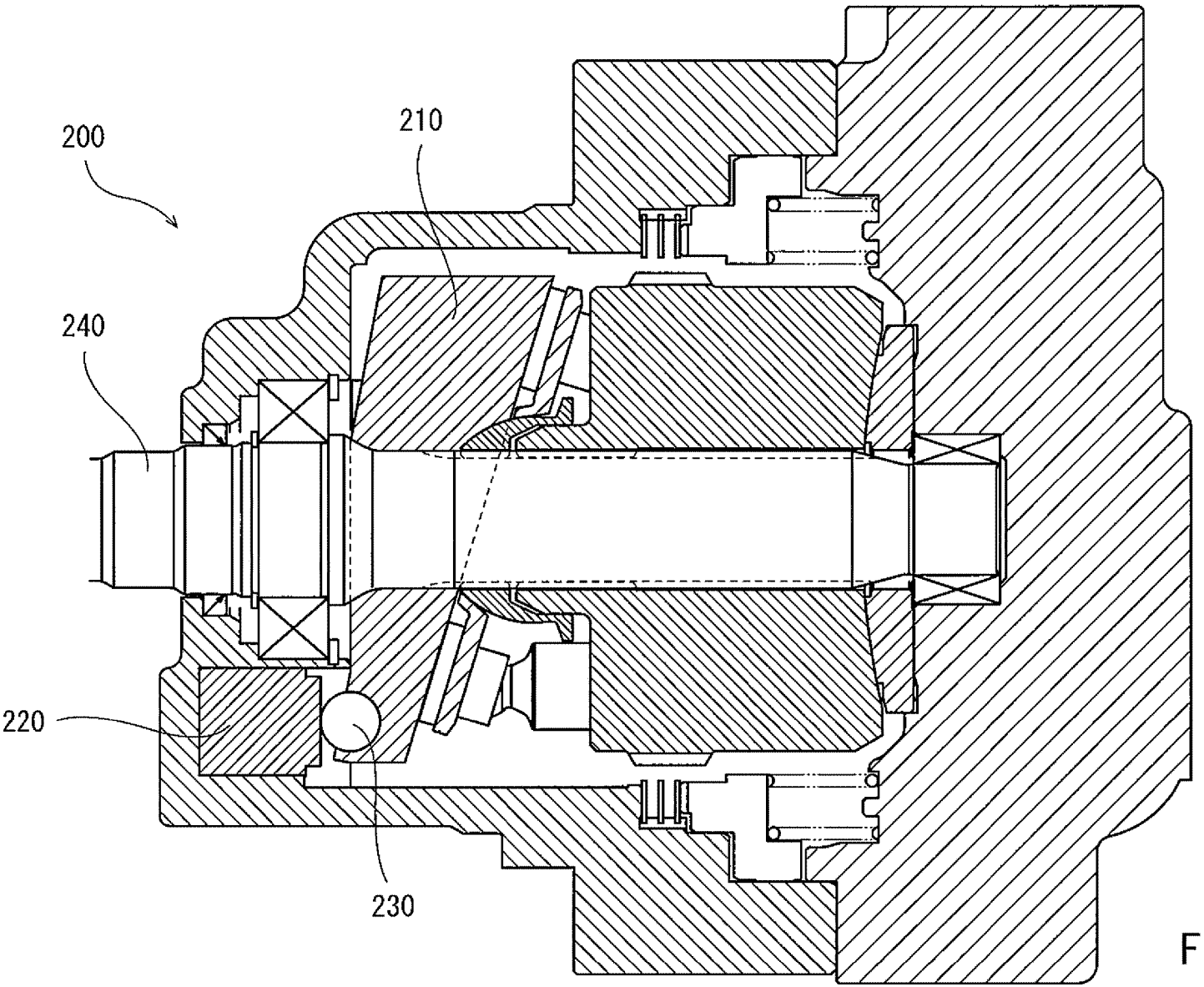
FIG. 8 is a sectional view of a hydraulic motor including a tilting piston and a tilting pin.
Figure 9:
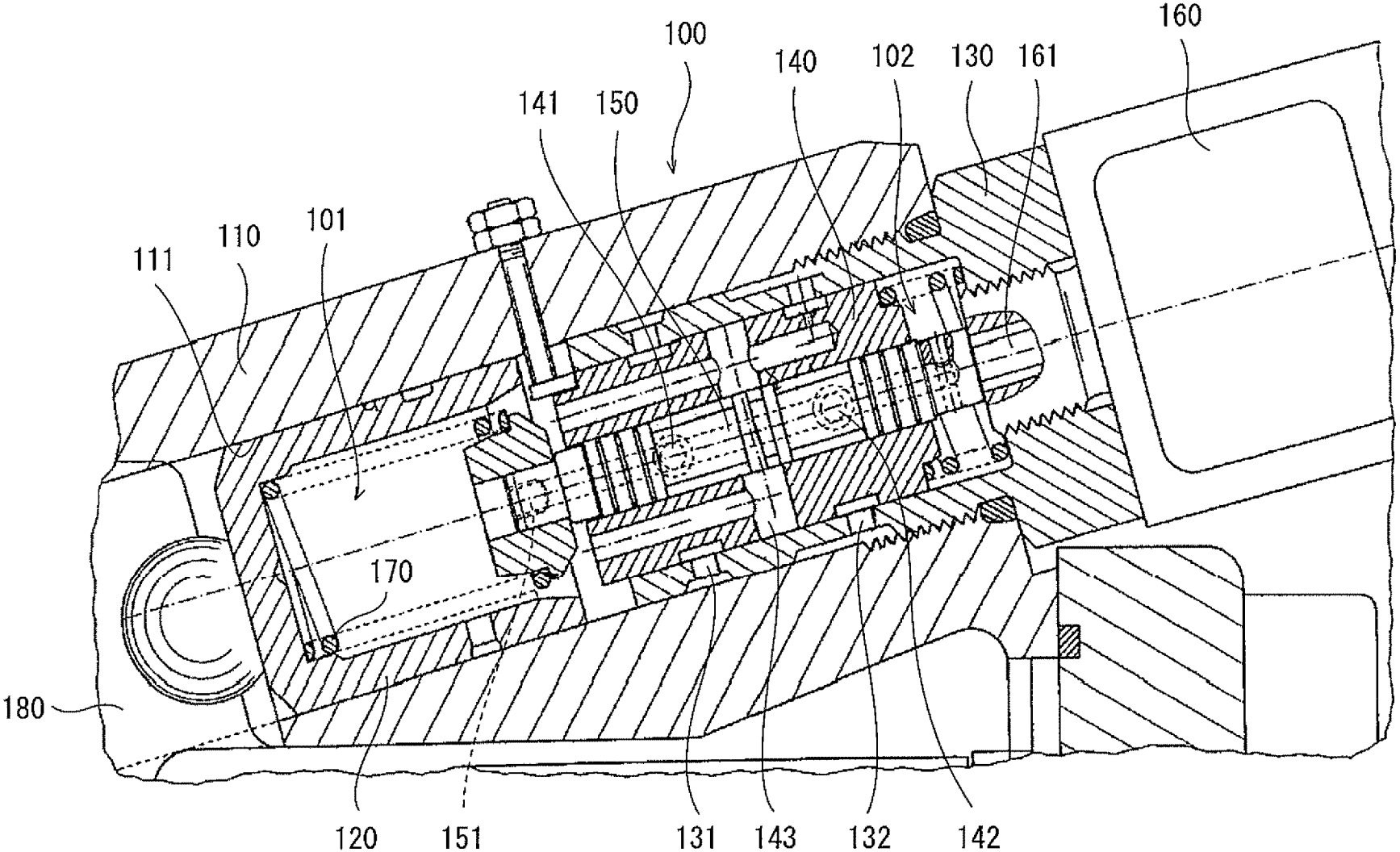
FIG. 9 is a sectional view of a conventional displacement adjusting device of a swash plate pump.

It should be noted that the configuration in which the tilting piston 3 presses the swash plate 93 via the tilting pin 95, which extends in the direction orthogonal to the swinging direction of the swash plate 93, is also applicable to a hydraulic motor 200 as shown in FIG. 8. The hydraulic motor 200 includes: a rotary shaft 240; a swash plate 210 configured to be swingable relative to the rotary shaft 240; and a tilting piston 220, which presses the swash plate 210 via a tilting pin 230 extending in a direction orthogonal to the swinging direction of the swash plate 210. In the illustrated example, the tilting pin 230 is held by the swash plate 210 and slides on the tilting piston 220. However, as an alternative, the tilting pin 230 may be held by the tilting piston 220 and may slide on the swash plate 210.

Conventionally, hydraulic pumps and hydraulic motors adopt a configuration in which a tilting piston presses a swash plate via a sphere. In some cases, the sphere is held by the swash plate and slides on the tilting piston, and in other cases, the sphere is held by the tilting piston and slides on the swash plate. However, in such a configuration, since the sphere makes point contact with the sliding member (the tilting piston or the swash plate), there are cases where the sphere and the sliding member wear significantly. In addition, in order for the sphere to be held by the holding member (the swash plate or the tilting piston), a process such as swaging is necessary, which causes increase in the manufacturing cost.

In this respect, in the case of using not a sphere but a tilting pin, since the tilting pin makes line contact with the sliding member, wear resistance can be improved compared to a case where the tilting piston presses the swash plate via a sphere. In addition, in the case of using a tilting pin, in order for the tilting pin to be held by the holding member, an inexpensive method such as press fit can be used. This makes it possible to reduce the manufacturing cost compared to a case where the tilting piston presses the swash plate via a sphere.

Moreover, in the case of using a tilting pin, the radial load exerted between the tilting piston and the accommodating hole is reduced compared to the case of using a sphere. This makes it possible to prevent the tilting piston from, for example, adhering to the accommodating hole. It should be noted that the tilting pin may be a cylindrical member having a round cross section, or may be a cylindrical member having an oval cross section.

The shape of the spool 5 is not limited to the shape shown in FIG. 2. For example, the spool 5 in which the grooves 55*a* are not formed in the rearward land 55 may be used, and when the current supplied to the solenoid 6 is between zero and a displacement adjustment starting value, the pressure in the control pressure chamber 11 may be maximized. That is, the presence or absence of the fail-safe function can be selected by replacing the spool 5.

REFERENCE SIGNS LIST

1 displacement adjusting device
11 control pressure chamber
12 reaction force chamber
13 tilting spring
2 housing
20 accommodating hole
23 first control pressure passage
24 second control pressure passage
3 tilting piston
4 sleeve
41 pump port
42 tank port
43 output port
spool
solenoid
61 rod
control pressure line
73, 75 bypass line
74 check valve
8 additional-function valve
9 swash plate pump
91 casing
93 swash plate
95 tilting pin

The invention claimed is:

1. A displacement adjusting device of a swash plate pump, the displacement adjusting device comprising:

a housing incorporated in a casing of the swash plate pump, the housing including an accommodating hole;

a tilting piston slidably inserted in the accommodating hole, the tilting piston pressing a swash plate of the swash plate pump;

a sleeve inserted in the accommodating hole and forming a control pressure chamber between the sleeve and the tilting piston, the sleeve including a pump port, a tank port, and an output port;

a spool slidably held by the sleeve, the spool switching whether to bring the output port into communication with one of the pump port and the tank port or block the output port from the pump port and the tank port;

a tilting spring disposed in the control pressure chamber, the tilting spring urging the tilting piston and the spool away from each other; and a solenoid including a rod that presses the spool from an opposite side to the tilting spring, wherein in the sleeve, a reaction force chamber and a communication passage are formed, the reaction force chamber being formed at an opposite side to the control pressure chamber, the communication passage being a passage through which the control pressure chamber communicates with the reaction force chamber, in the housing, a first control pressure passage that communicates with the output port and a second control pressure passage that communicates with the control pressure chamber are formed, the first control pressure passage and the second control pressure passage each forming a part of a control pressure line that connects the output port to the control pressure chamber, and the displacement adjusting device further comprises:

at least one additional-function valve provided on the control pressure line;

a bypass line that connects a part of the control pressure line upstream of the at least one additional-function valve and a part of the control pressure line downstream of the at least one additional-function valve; and a check valve provided on the bypass line, the check valve allowing a flow from the part of the control pressure line upstream of the at least one additional-function valve toward the part of the control pressure line downstream of the at least one additional-function valve and preventing a reverse flow.

2. The displacement adjusting device of a swash plate pump according to claim 1, wherein the tilting piston presses the swash plate via a tilting pin that extends in a direction orthogonal to a swinging direction of the swash plate.

3. The displacement adjusting device of a swash plate pump according to claim 1, wherein the spool is configured to be pressed by the rod to bring the pump port into communication with the output port and block the tank port from the reaction force chamber when a current between a first setting value and a second setting value is supplied to the solenoid.

4. The displacement adjusting device of a swash plate pump according to claim 3, wherein the tilting piston presses the swash plate via a tilting pin that extends in a direction orthogonal to a swinging direction of the swash plate.

5. The displacement adjusting device of a swash plate pump according to claim 1, wherein the swash plate is urged by a swash plate spring from an opposite side of the swash plate relative to the tilting piston, and the spool is configured to block the pump port and bring the tank port into communication with the reaction force chamber when no current is supplied to the solenoid.

6. The displacement adjusting device of a swash plate pump according to claim 5, wherein the spool is configured to be pressed by the rod to bring the pump port into communication with the output port and block the tank port from the reaction force chamber when a current between a first setting value and a second setting value is supplied to the solenoid.

7. The displacement adjusting device of a swash plate pump according to claim 6, wherein the tilting piston presses the swash plate via a tilting pin that extends in a direction orthogonal to a swinging direction of the swash plate.

8. The displacement adjusting device of a swash plate pump according to claim 5, wherein the tilting piston presses the swash plate via a tilting pin that extends in a direction orthogonal to a swinging direction of the swash plate.

9. A displacement adjusting device of a swash plate pump, the displacement adjusting device comprising:

a housing incorporated in a casing of the swash plate pump, the housing including an accommodating hole;

a tilting piston slidably inserted in the accommodating hole, the tilting piston pressing a swash plate of the swash plate pump;

a sleeve inserted in the accommodating hole and forming a control pressure chamber between the sleeve and the tilting piston, the sleeve including a pump port, a tank port, and an output port;

a spool slidably held by the sleeve, the spool switching whether to bring the output port into communication with one of the pump port and the tank port or block the output port from the pump port and the tank port;

a tilting spring disposed in the control pressure chamber, the tilting spring urging the tilting piston and the spool away from each other; and a solenoid including a rod that presses the spool from an opposite side to the tilting spring, wherein in the sleeve, a reaction force chamber and a communication passage are formed, the reaction force chamber being formed at an opposite side to the control pressure chamber, the communication passage being a passage through which the control pressure chamber communicates with the reaction force chamber, the swash plate is urged by a swash plate spring from an opposite side of the swash plate relative to the tilting piston, and the spool is configured to block the pump port and bring the tank port into communication with the reaction force chamber when no current is supplied to the solenoid.

10. The displacement adjusting device of a swash plate pump according to claim 9, wherein the spool is configured to be pressed by the rod to bring the pump port into communication with the output port and block the tank port from the reaction force chamber when a current between a first setting value and a second setting value is supplied to the solenoid.

11. The displacement adjusting device of a swash plate pump according to claim 10, wherein the tilting piston presses the swash plate via a tilting pin that extends in a direction orthogonal to a swinging direction of the swash plate.

12. The displacement adjusting device of a swash plate pump according to claim 9, wherein the tilting piston presses the swash plate via a tilting pin that extends in a direction orthogonal to a swinging direction of the swash plate.

* * * * *